US010562692B2

(12) United States Patent
Foerg et al.

(10) Patent No.: US 10,562,692 B2
(45) Date of Patent: Feb. 18, 2020

(54) MULTI-CHAMBER FILM BAG AND USE THEREOF

(71) Applicant: HILTI AKTIENGESELLSCHAFT, Schaan (LI)

(72) Inventors: Christian Foerg, Dillishausen (DE); Jekaterina Miller, Augsburg (DE); Esther Rahel Kluj, Landsberg (DE); Mario Paetow, Igling (DE)

(73) Assignee: Hilti Aktiengesellschaft, Schaan (LI)

( * ) Notice: Subject to any disclaimer, the term of this patent is extended or adjusted under 35 U.S.C. 154(b) by 33 days.

(21) Appl. No.: 15/768,550

(22) PCT Filed: Oct. 24, 2016

(86) PCT No.: PCT/EP2016/075490
§ 371 (c)(1),
(2) Date: Apr. 15, 2018

(87) PCT Pub. No.: WO2017/072058
PCT Pub. Date: May 4, 2017

(65) Prior Publication Data

US 2018/0305108 A1 Oct. 25, 2018

(30) Foreign Application Priority Data

Oct. 30, 2015 (EP) ..... 15192407

(51) Int. Cl.
*B65D 81/32* (2006.01)
*B65D 35/32* (2006.01)
(Continued)

(52) U.S. Cl.
CPC ..... *B65D 81/3266* (2013.01); *B01F 3/04446* (2013.01); *B65D 35/32* (2013.01); *A62C 5/02* (2013.01); *A62C 13/62* (2013.01)

(58) Field of Classification Search
CPC .... B65D 81/3266; B65D 35/32; B65D 81/32; B65D 83/0055; B65D 83/0066;
(Continued)

(56) References Cited

U.S. PATENT DOCUMENTS 3,332,670 A * 7/1967 Swartz ..... B01F 11/0065 416/67
4,731,053 A 3/1988 Hoffman
(Continued)

FOREIGN PATENT DOCUMENTS

DE 38 30 630 3/1990
EP 2 045 227 4/2009
(Continued)

OTHER PUBLICATIONS

International Search Report mailed in PCT/EP2016/075490 dated Dec. 20, 2016, with translation.
(Continued)

*Primary Examiner* — Anthony D Stashick
*Assistant Examiner* — L E Kmet
(74) *Attorney, Agent, or Firm* — Grüneberg and Myers PLLC

(57) ABSTRACT

A multi-chamber bag portion can be used as a package for a curable multi-component compound. The multi-chamber bag portion has at least two chambers separated from one another in liquid-tight manner, where one of the chambers is filled with a reactive component and at least one other chamber with a hardener component for the reactive component. The multi-chamber bag portion also has at least one separating element, which in storage condition separates the chambers from one another in liquid-tight manner and in ready-to-use condition provides fluidic communication between the chambers for mixing of the reactive component and the hardener component. An opening portion, which can
(Continued)

be opened to discharge the mixed multi-component compound, is also a component of the multi-chamber bag portion.

15 Claims, 2 Drawing Sheets

(51) Int. Cl.
*A62C 5/02* (2006.01)
*B01F 3/04* (2006.01)
*A62C 13/62* (2006.01)

(58) Field of Classification Search
CPC .... B65D 25/08; B65D 83/62; B65D 81/3261; A61J 1/2093
USPC ..... 206/221, 219; 383/38
See application file for complete search history.

(56) References Cited

U.S. PATENT DOCUMENTS 6,395,317 B1* 5/2002 Singh ..... B65B 61/188 206/5
6,648,133 B1* 11/2003 Blaschke ..... A61F 2/0095 206/221
2001/0030134 A1* 10/2001 Goglio ..... B65D 81/3266 206/221
2002/0066678 A1* 6/2002 Sharon ..... B65D 47/30 206/219
2004/0112843 A1* 6/2004 Benham ..... B65D 31/00 210/749
2008/0149526 A1* 6/2008 Sivakumar ..... A47L 13/17 206/568
2014/0248436 A1* 9/2014 Awbery-Maskell ..... B65D 81/3266 427/356
2015/0041492 A1* 2/2015 Tunney ..... B65D 35/24 222/92
2015/0043838 A1* 2/2015 Jaouen ..... A45D 34/00 383/38
2018/0022526 A1* 1/2018 Demarest ..... B05C 17/00553 433/90

FOREIGN PATENT DOCUMENTS

GB 370 204 4/1932
WO 2002/016216 2/2002

OTHER PUBLICATIONS

Written Opinion of the International Searching Authority mailed in PCT/EP2016/075490 dated Dec. 20, 2016.

* cited by examiner

MULTI-CHAMBER FILM BAG AND USE THEREOF

This application is a National Stage entry under § 371of International Application No. PCT/EP 2016/075490, filed on Oct. 24,2016, and which claims priority to European Patent Application No. 151192407.3, filed on Oct. 30,2015.

The invention relates to a multi-chamber film bag for a curable multi-component compound and to the use of the multi-chamber film bag for packaging and/or processing of the multi-component compound. Furthermore, the invention relates to the use of the multi-chamber film bag in a process for manufacturing a multi-component compound, especially a foam-in-place foam and especially an inorganic fire-protection foam.

For rapid sealing of openings, such as fire-protection penetrations in the building sector, for example, or for anchoring of building parts in boreholes, a reactive material of two components is mixed in place and introduced into the opening. The reactive material should be stable until it cures and should not flow back out of the opening.

In two-component compounds of liquid resins such as polyurethane or epoxy resin, stability is achieved by appropriate adjustment of the viscosity of the material. The reactive components are introduced separately into two-component cartridges with a static mixer and are mixed at the point of application by expelling them from the cartridge in the static mixer.

Compounds consisting of powders and liquids are mechanically mixed with one another in an open vessel using a stirring rod or other mixing aids. The mixed compound may then be introduced manually into the opening to be filled and/or transformed to the desired shape, or are filled into further application aids, such as a kneading press, for example, and introduced into the opening.

Multi-component systems for manufacturing gypsum foams and/or cement foams by mixing in open vessels are known, for example, from EP 2 045 227 A. The hydraulically binding composition described therein is used for manufacturing inorganic fire-protection or insulating foam-in-place foams. It comprises a pH-neutral or alkaline hydraulic binder and a foaming component as well as a foam stabilizer, wherein the foaming component releases oxygen or carbon dioxide. However, the known inorganic fire-protection systems can be introduced into openings only with difficulty and are frequently usable only as a grouting compound with complex formwork devices.

If a powder is to be mixed with liquid in a closed container, further aids such as balls, for example, are needed in a space partly filled with air. A substantially liquid consistency of the mixture is necessary for emptying the container.

Furthermore, liquid two-component grouting resins are known, which are introduced in a two-chamber film bag with clamp-type closure. In this case the liquid grouting resin is mixed manually after removal of the clamp-type closure and is then poured into cable lugs, for example.

Furthermore, for expelling pasty compounds from tubes or film bags, various winding and spreading devices are known, including in combination with one another. These aids have a longitudinal slit formed between two slats, into which the fold of the tube is introduced, wherein the contents of the tube are then expelled either by winding the tube up from the end of the tube or by sliding the slats up to compress the tube.

Simple and inexpensive packaging for good mixing and application of curable multi-component compounds in a closed container has not been known heretofore.

Two-component cartridges or two-component film packages with static mixer have a certain dead volume in the mixer. Furthermore, the mixture quality is inadequate at the beginning of mixing, and so the initial output has to be removed and discarded. Furthermore, a residual quantity remains in the static mixer. In commercial systems, this residual quantity amounts to approximately 30 g of two-component compound, while the quantity removed as initial output amounts to approximately 15 g. Thus a loss of approximately 45 g of curable compound must be expected per application. If the user has to create only a small number of four to five fastening points, for which approximately 10 to 15 g of compound is needed per fastening point, the percentage lost quantity comes to approximately 50% or more. In addition, a new static mixture is needed if several applications are to be made with the same package. Thus high losses and correspondingly high material costs must be anticipated during use of small quantities of the two-component compound.

Clamp-type bags are adequate for liquid grouting resin, because the compound is able to flow out of the bags. Stable pasty compounds are more difficult to process with conventional clamp-type bags, since the compounds must be expelled manually from the bag with pressure. In general, emptying of the residues from the clamp-type bag is not satisfactory, and the users try to empty the residual quantities from the bag by scrunching or wringing the bag.

Spreading devices have the disadvantage that the tube or the bag must be held at the rear end in order to pull the bag through the spreader and expel the compound from the bag. While doing so, the user does not have the ability to apply the compound emerging from the bag opening selectively. Emptying of residual quantities is also not optimum in this case, because the compound is also able to penetrate through the spreading gap into the rear region of the bag. However, narrowing of the spreading gap has the consequence that the force needed for expelling the contents from the bag becomes very high.

Winding devices are usually available only separately and do not match various systems and sizes of tubes or film bags. Threading of the bag seam into the winding device is not always simple; the roller may slip and, during the first revolutions, hardly apply enough force to create the pressure necessary to expel the contents from the bag. Greater force can be applied only when the film layers are pressed against one another.

The object underlying the invention is to provide a simple, user-friendly and inexpensive form of use and packaging for good mixing and application of curable multi-component compounds in a closed container, especially for chemical anchors or for an inorganic foam on the basis of gypsum or cement mortar for insulating or fire-protection purposes with solid, powdered and liquid components. The form of use should permit mixing of the compounds without complex tools and make it possible to introduce the compound even into openings that are narrow and/or difficult to access. In doing so, it should also be possible to process small quantities without losses of initial output and/or losses of residual quantities.

This object is solved by a multi-chamber film bag according to claim 1. Subject matter of the invention is further the use of the multi-chamber film bag according to claim 13 for packaging and/or processing of a curable multi-component compound, as well as a process for manufacturing and processing a curable multi-component compound using the inventive multi-chamber film bag having the features of claim 14.

Advantageous and expedient configurations of the inventive process and of the inventive film bag are specified in the associated dependent claims.

The invention provides a multi-chamber film bag for a curable multi-component compound, with at least two chambers separated from one another in liquid-tight manner, wherein one of the chambers is filled with a first component and at least one other chamber with a hardener component for the first component. Furthermore, the multi-chamber film bag comprises a separating element, which in storage condition separates the chambers from one another in liquid-tight manner and in ready-to-use condition provides fluidic communication between the chambers for mixing of the first component and the hardener component. The bag has an opening portion, which can be opened to discharge the mixed multi-component compound. The separating element comprises a clamping rail equipped with a longitudinal groove and a clamping strip. Either the clamping rail or the clamping strip is securely joined to a border of the film bag disposed opposite the opening portion. The part of the separating element joined securely to the border of the film bag has a gripping portion, which permits a rotational movement of the securely joined part in order to wind the film bag up to the securely joined part.

Thus the separating element combines the function of mutual sealing of the chambers with the function of a winding device. Thereby the winding device for expelling the contents from the bag does not have to be supplied separately. Moreover, the time-consuming threading of the bag seam into the winding device is eliminated. Since mixing of the components takes place in the sealed bag after removal of the clamping strip, the entire quantity of mixed compound can be used effectively. No initial output is produced that would have to be discarded due to inadequate mixing of the components. Furthermore, the winding device permits almost complete emptying of the residues even in the case of use of film bags of plastic, which cannot be assured by manually expelling the contents from the bag. Thus there is no need to use special expelling devices.

The inventive multi-chamber film bag further makes it possible to provide film packages with fixed quantities, predetermined by the packaging, of the reactive components for the curable multi-component compound. Thus erroneous dosing by the user can be reliably prevented and the mixture is ready for immediate use. Moreover, even small packages of approximately 30 to 100 g can be provided simply and cost-effectively in this way. The separating element of the multi-component film bag can be opened simply without tools. Good mixing results can be achieved by simple kneading of the components.

The part of the separating element joined securely to the film bag permits simple operation with one hand, so that the opening portion can be guided with the other hand and the mixed multi-component compound can be applied selectively from the opening portion into an opening of the building. The opening portion may be further constructed as a nozzle tip and in this way permit selective application of the compound even into openings that are narrow and difficult to access. Furthermore, after the components have been mixed in the film bag, the compound can already be present in stable consistency, in order to prevent the compound from flowing out of the openings to be filled.

Furthermore, inexpensive and space-saving film packaging is provided with the invention. During mixing, contact of the user with the reactive components is excluded, and so a health hazard is avoided. Finally, additional mixing elements such as static mixers and even mixing tools and mixing containers are also not necessary, since mixing of the components takes place inside the film packaging. Thus the otherwise necessary tasks of cleaning the tools are also eliminated.

Although the invention is described hereinafter on the basis of a two-component system, multi-component systems, which contain more than two reactive components that can be introduced into more than two chambers separated from one another in the film bag, are also comprised by the invention and can be implemented with little complexity.

According to a preferred embodiment, the curable multi-component compound is a curable organic compound, especially on the basis of epoxides, (meth)acrylates or polyurethane.

According to a further embodiment, the multi-component compound is an inorganic multi-component compound comprising a hydraulically binding component as the reactive component, which may also be in powder form, and a water-containing component as the hardener component. Cements, especially Portland cement, trass, pozzolan, hydraulic lime and gypsum or mixtures thereof may be used as the hydraulic binder. Water or aqueous solutions may be used as the hardener component.

Preferably, the inorganic multi-component compound is an inorganic fire-protection foam or insulating foam with at least one hydraulic binder, a foaming component and a foam stabilizer. The foaming component may be formed from an an alkali metal or alkaline earth carbonate or bicarbonate and an acid, and/or from an oxygen carrier and a catalyst. In particular, hydrogen peroxide in aqueous solution may be used as the oxygen carrier. The catalyst may comprise manganese dioxide, $MnO_2$. Such foam systems are known from EP 2 045 227 A1, to which reference is made herewith.

The multi-chamber film bag may be formed as a flat bag or else as a tubular bag. The manufacture of these systems is known in principle to the person skilled in the art. Flat bags are usually formed by placing two plastic films one on top of the other and welding the films along the borders. Tubular bags expedient for the present invention are obtained by injecting the plastic films from round nozzles to form a film tube and welding the ends of the tube. Preferably, the inventive multi-chamber film bag is a flat bag of plastic with securely welded side borders.

In a preferred embodiment, the at least two chambers directly adjoin one another. This embodiment is suitable for all applications in which the at least two components can be physically mixed well with one another, such as low-viscosity components, for example, or a low-viscosity component with a powdered component.

Furthermore, the multi-chamber film bag has an opening portion, which can be opened to discharge the mixed multi-component compound. In this embodiment, the opening portion is preferably comprised by one of the two chambers.

In an alternative embodiment, the at least two chambers are disposed at a distance from one another and a bag portion with reduced cross section is disposed between the chambers. Hereby better intermixing is achieved, since the compound can be forced in alternating manner through a constriction. This embodiment therefore permits the mixing of highly viscous components. In this embodiment, the component of that chamber which is not bounded by the separating element may be separated by a further separating element, for example a clamp or peel seam, from the bag portion with reduced cross section. Finally, filling of the bag portion having reduced cross section with a further reactive component is also provided. The bag portion then itself forms a chamber separated in liquid-tight manner from the other chambers.

In this embodiment, the opening portion is preferably comprised by the bag chamber with reduced cross section.

In one embodiment of the multi-chamber film bag, the opening portion is provided with a screw cap welded in the film bag. A screw cap makes it possible to attach commercial cartridge nozzles or nozzle tips, with which the multi-component compound may be discharged from the film bag in a manner appropriate for the desired purpose of use at the point of application.

According to a further embodiment, the opening portion may be formed to discharge the multi-component mass through a nozzle tip or plastic socket, preferably tapering sharply or conically, welded in the film bag. Preferably, the nozzle tip or plastic socket is closed at its free end and, depending on the desired size of nozzle opening, will be cut to size at the point of application or broken off at a provided zone of weakness, such as an annular predetermined breaking point. If the nozzle tips are provided with weak zones, no scissors or knives are needed to open the expulsion tip. If necessary, the nozzle tip may also be extended by slipping on a further plastic tip. The use of nozzle tips with a conically or sharply tapering expulsion opening and a predetermined opening cross section permits selective introduction of the foam system even into narrow gaps with poor accessibility. Thus openings in the building can be filled rapidly, simply and inexpensively with the curable multi-component compound.

Particularly preferably, the portion for discharging the foam system is formed by a socket molded in one piece onto the film bag. The socket may be tubular or may taper conically or sharply toward its free end opposite the chamber. Particularly preferably, the socket is provided at its free end with a weak zone, such as a tear seam, for example, to permit tearing of the socket without tools. In this way, even openings that are difficult to access can be filled rapidly, simply and inexpensively with the multi-component compound.

According to the invention, the separating element comprises a clamping rail equipped with a longitudinal groove and a clamping strip. Preferably the clamping rail has a channel profile.

Either the clamping rail or the clamping strip is securely joined to a border of the film bag disposed opposite the opening portion and has a gripping portion, which permits rotational movement of the joined part in order to wind the film bag up to the joined part. The joint is made preferably by adhesive bonding or welding. The gripping portion is shaped such that it facilitates the rotational movement for the user. Preferably, the gripping portion has the form of a ball, a wheel, a cross, a wing or a strip.

The other part of the separating element, corresponding to the clamping rail or clamping strip, may exist as a loose part or may likewise be fastened externally on one of the flat sides of the film bag, for example by adhesive bonding or welding with the film wall.

For liquid-tight separation of a chamber from the rest of the contents of the bag, the film bag is placed with one flat side on the longitudinal groove of the clamping rail, the film bag is folded over and the clamping strip is pressed from the other flat side of the film bag into the longitudinal groove. Thereby the film walls of the film bag disposed opposite one another are pressed together, and liquid-tight separation of the chambers adjoining the clamp-type closure is formed in the film bag.

According to a further embodiment, compulsory mixing joints may be provided in the region of the separating element to permit faster and more homogeneous mixing of the components. In particular, solid stays may be provided in the region of the separating element, between the film walls, disposed opposite one another, of the film bag, or weld seams may be provided, which remain intact and do not tear open due to pressure on one of the chambers.

Subject matter of the invention is therefore also a use of the multi-chamber film bag for packaging and/or processing of a curable multi-component compound and especially of an inorganic multi-component foam system.

By use of the inventive multi-chamber film bag, it is possible to manufacture and process a curable multi-component compound, wherein one of the chambers of the multi-chamber film bag is filled with a reactive component and another chamber with a hardener component for the reactive component, wherein the chambers, in a first storage condition, are separated from one another in liquid-tight manner by at least one separating element and wherein, in a second ready-to-use condition, fluidic communication between the chambers is established by opening of the separating element and the reactive component is mixed in the film bag with the hardener component. After the components have been mixed, the opening portion is opened and the film bag is wound up to the clamping rail or clamping strip in the direction of the opening portion, so that the mixed components are expelled from the opening portion.

The curable multi-component compound is preferably a chemical anchor or an inorganic multi-component foam system, more preferably an inorganic two-component foam system and especially an inorganic fire-protection foam.

The use of nozzle tips with a sharply or conically tapering expulsion opening and a predetermined opening cross section permits selective introduction of the foam system even into narrow gaps with poor accessibility. The nozzle tips may be provided with weak zones, so that no scissors or knives are needed to open the expulsion tip. Thus, for example, openings can be filled rapidly, simply and inexpensively with the curable multi-component compound.

Preferably, mixing of the components in the ready-to-use condition takes place by manual kneading of the compound in the sealed film bag.

Further features and advantages of the invention will become apparent from the description hereinafter and from the attached drawings, to which reference is made. In the drawings.

Figure 1:
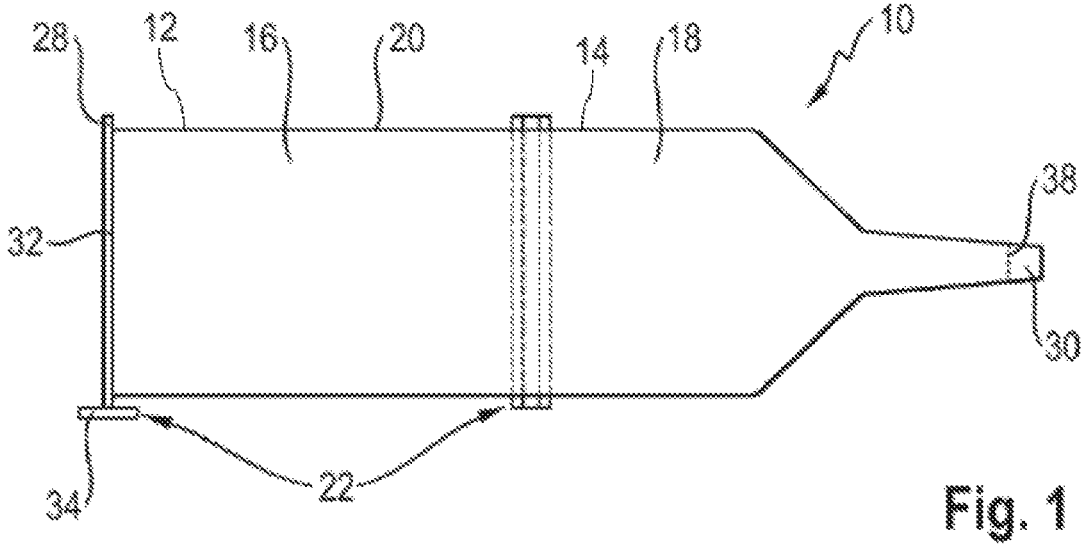
FIG. 1 shows a schematic diagram of the inventive film bag according to a first embodiment, with opened separating element.

Multi-chamber film bag 10 illustrated in FIG. 1 has two chambers 12, 14, wherein chamber 12 is filled with a reactive component 16 and chamber 14 with a hardener component 18 for the first component.

Multi-chamber film bag 10 is presented here as a flat bag of plastic with securely welded side border 20. Alternatively, a tubular bag may also be used, which then does not have any welded side border 20 but is closed, preferably welded, only at the ends of the tube.

In the embodiment illustrated in FIG. 1, the two chambers 12, 14 directly adjoin one another. This embodiment is suitable for all applications with components that can be physically mixed well, such as low-viscosity components or a low-viscosity component and a pasty or powdered component, for example.

In FIG. 1, bag 10 is illustrated in the ready-to-use condition with opened separating element 22. Separating element 22 comprises a clamping rail 24 with longitudinal groove 26 and a clamping strip 28. In the embodiment illustrated here, clamping strip 28 is securely joined to a border 32 of film bag 10 disposed opposite the opening portion 30 and is provided with a gripping portion 34. Clamping rail 24 may be supplied as a separate, loose part or may be joined to film bag 10, for example by adhesive bonding on an external film wall of the film bag. Alternatively, clamping rail 24 may also be securely joined to border 32 and support gripping portion 34. In this case, clamping strip 28 may exist as a loose part or be joined to the film bag. Tear seam 38 formed on opening portion 30 for simplified opening of the bag is shown. This may be advantageously supplemented or replaced by a notch.

Figure 2:
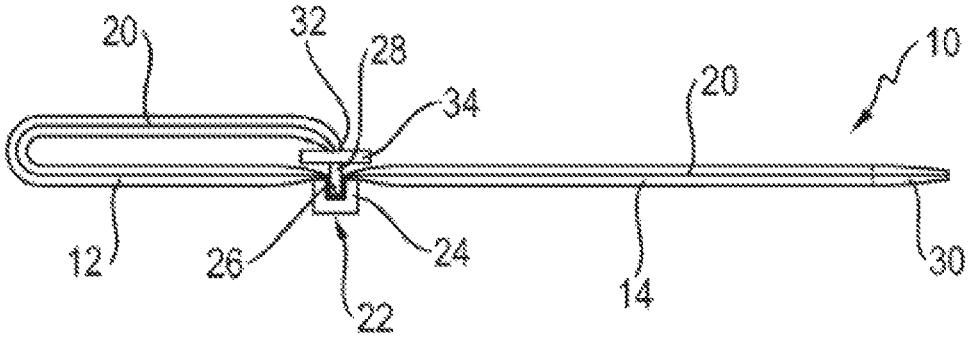
FIG. 2 shows a side view of a schematic diagram of the inventive film bag according to the first embodiment, with closed separating element.

FIG. 2 shows a side view of bag 10 described in FIG. 1 in the storage condition with closed separating element 22. Bag 10 is folded over in the region of chamber 12, and chambers 12, 14 are separated from one another in liquid-tight manner by closed separating element 22. One flat side of film bag 10 rests on longitudinal groove 26 of clamping rail 24. Clamping strip 28 joined to border 32 is inserted from the opposite flat side of film bag 10 into longitudinal groove 26 and presses the film walls of film bag 10 disposed between clamping strip 28 and clamping rail 24 together in longitudinal groove 26. In this way, separating element 22 separates chambers 12, 14 from one another in liquid-tight manner.

Further compulsory mixing joints (not shown) in the form of continuous weld seams may be provided in the region of separating element 22. After separating element 22 has been opened in the ready-to-use condition of film bag 10, these provide for compulsory mixing of the components in chambers 12, 14.

Figure 3:
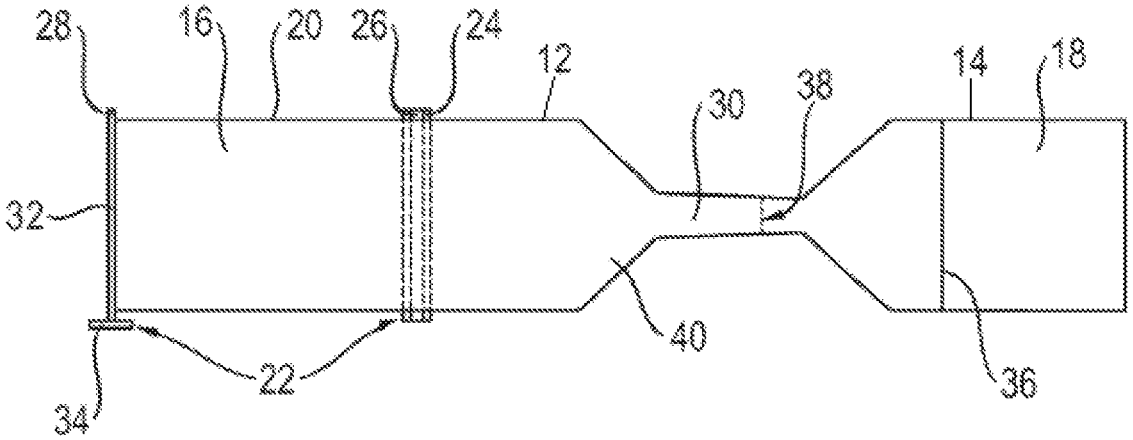
FIG. 3 shows a schematic diagram of the inventive film bag according to a further embodiment, with opened separating element.

FIG. 3 shows a further embodiment of film bag 10 with opened separating element 22. In this embodiment, chambers 12, 14 are disposed at a distance from one another. A bag portion 40 with reduced cross section is situated between chambers 12, 14. Hereby better intermixing is achieved, since the compound can be forced in alternating manner through a constriction. This embodiment therefore permits the mixing of highly viscous components.

In the illustrated embodiment, hardener component 18 in chamber 14 is bounded by a further separating element 36, in this case a heat-sealed peel seam, and is separated in liquid-tight manner from bag portion 40 with reduced cross section. Alternatively, a clamping seam such as a lip closure or a zipper closure may also be provided here. It is also possible to form further separating element 36 by a clamping rail, in which a clamping strip is inserted, whereby chamber 14 is separated from the rest of the contents of the bag. The clamping rail and/or the clamping strip may exist as loose parts or be fastened on the film bag. In two-component systems, it is also possible to do without further clamping element 36.

For manufacturing and processing of the curable multi-component compound, one of the chambers 12, 14 of multi-chamber film bag 10 is filled with a reactive component 16 and the other chamber 12, 14 with a hardener component 18 for reactive component 16. In the storage condition, chambers 12, 14 are separated from one another in liquid-tight manner by separating element 22. For this purpose, clamping rail 24 is placed on one flat side of film bag 10 and film bag 10 is held from the opposite flat side of film bag 10 by pressing clamping strip 28 into longitudinal groove 26 of clamping rail 24 (FIG. 2). In this way, two separate chambers 12, 14 are formed that are separated from one another in liquid-tight manner by the fact that the film walls of film bag 10 are pressed together in longitudinal groove 26 of clamping rail 24.

To transform the film bag shown in FIG. 1 into the ready-to-use condition, when the curable compound is to be processed and filled into openings of the building, separating element 22 is opened by removing clamping strip 28 from longitudinal groove 26 of clamping rail 24, thus providing fluidic communication between chambers 12, 14. Reactive component 16 is mixed with hardener component 18 by manual kneading while film bag 10 is closed. After components 16, 18 have been mixed, opening portion 30 is opened by tearing tear seam 38 and film bag 10, starting from border 32, is wound in the direction of opening portion 30 up to clamping rail 24 or clamping strip 28. Winding may be achieved with one hand via gripping portion 34, while the opening portion is guided with the other hand on or in the opening to be filled. When the film bag is wound up to clamping strip 28 or clamping rail 24, the mixed curable compound is expelled from opening portion 30 and introduced into the opening of the building. Almost complete emptying of the residues is possible with the inventive film bag. Thus less waste is produced and the manufacturing costs per opening to be filled can be significantly reduced.

Figure 4:
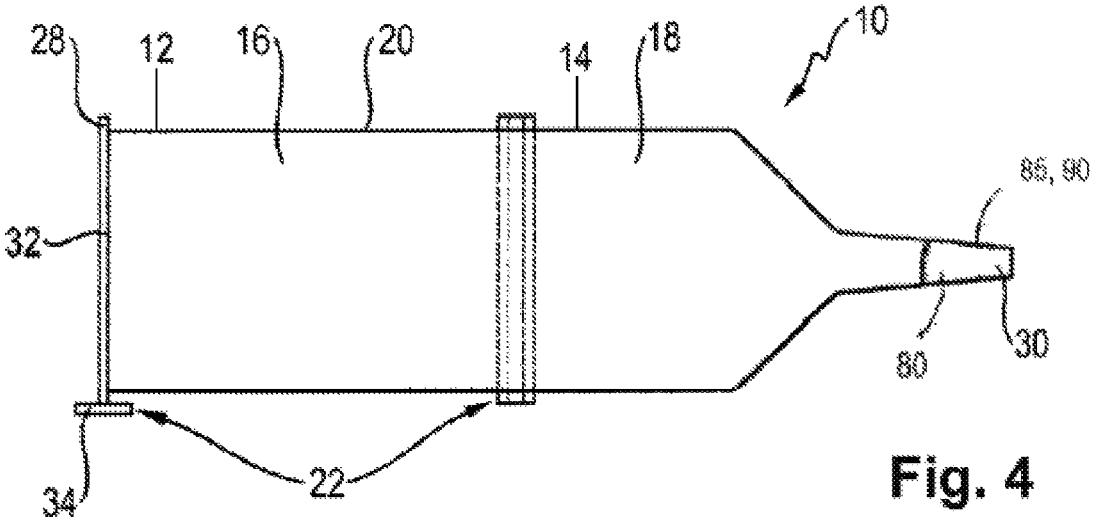
FIG. 4 shows a schematic diagram of the inventive film bag according to another embodiment.

In one embodiment, the opening portion 30 may be provided with a screw cap 80, for example, as shown in FIG. 4. The screw cap may make it possible to attach commercial cartridge nozzles or nozzle tips 85, with which the multi-component compound may be discharged from the film bag in a manner appropriate for the desired purpose of use at the point of application. In one case, the nozzle tip 85 or a socket 90 having a tapered shape may be welded to the film bag, as alternatively shown in FIG. 4.

To transform the film bag shown in FIG. 3 into the ready-to-use condition, when the curable compound is to be processed and filled into openings of the building, separating element 22 is opened by removing clamping strip 28 from longitudinal groove 26 of clamping rail 24 and further separating element 36 (heat-sealed peel seam) by pressure on chamber 14, thus providing fluidic communication between chambers 12, 14 via bag portion 40 with reduced cross section. Reactive component 16 is transferred into chamber 12 by being expelled and completely emptied from bag 14, and is mixed with hardener component 18 by manual kneading while film bag 10 is closed. Return flow of the component can be prevented, for example by pinching off bag 14 in the region of bag portion 40 with reduced cross section. After components 16, 18 have been mixed, bags 12 and 14 are separated from one another by tearing tear seam 38, opening portion 30 is opened and film bag 10, starting from border 32, is wound in the direction of opening portion 30 up to clamping rail 24 or clamping strip 28. Winding may be achieved with one hand via gripping portion 34, while the opening portion is guided with the other hand on or in the opening to be filled. When the film bag is wound up to clamping strip 28 or clamping rail 24, the mixed curable compound is expelled from opening portion 30 and introduced into the opening of the building. Almost complete emptying of the residues is possible with the inventive film bag. Thus less waste is produced and the manufacturing costs per opening to be filled can be significantly reduced.

LIST OF REFERENCE SYMBOLS

10 Multi-chamber film bag
12 First chamber
14 Second chamber
16 Reactive component
18 Hardener component
20 Side border, welded
22 Separating element
24 Clamping rail
26 Longitudinal groove
28 Clamping strip
30 Opening portion
32 Border of the film bag opposite opening portion 30
34 Gripping portion
36 Further separating element
38 Tear seam
40 Bag portion with reduced cross section

The invention claimed is:

1. A multi-chamber bag portion for a curable multi-component compound, comprising:

at least two chambers separated from one another in liquid-tight manner, wherein one of the chambers is filled with a reactive component and at least one other chamber with a hardener component for the reactive component, at least one separating element, which in storage condition separates the chambers from one another in liquid-tight manner and in ready-to-use condition provides fluidic communication between the chambers for mixing of the reactive component and the hardener component, and an opening portion, which can be opened to discharge the mixed multi-component compound, wherein the separating element comprises a clamping rail equipped with a longitudinal groove and a clamping strip, and wherein either the clamping rail or the clamping strip is securely joined to a border of the film bag disposed opposite the opening portion and has a gripping portion, which permits a rotational movement of the clamping rail or of the clamping strip in order to wind the film bag up to the clamping rail or the clamping strip.

2. The multi-chamber film bag according to claim 1, wherein the multi-component compound is an organic compound comprising an epoxide, a (meth)acrylate, or a polyurethane.

3. The multi-chamber film bag according to claim 1, wherein the multi-component compound is an inorganic multi-component compound with a hydraulically binding component as the reactive component and a water-containing component as the hardener component.

4. The multi-chamber film bag according to claim 3, wherein the multi-component compound is an inorganic fire-protection foam or insulating foam.

5. The multi-chamber film bag according to claim 1, wherein the at least two chambers directly adjoin one another.

6. The multi-chamber film bag according to claim 1, wherein the at least two chambers are disposed at a distance from one another, a first one of the at least two chambers having a first cross section, a second one of the at least two chambers having a second cross section, and the multi-chamber film bag includes a bag portion disposed between the chambers, the bag portion having a third cross section less than the first cross section and the second cross section.

7. The multi-chamber film bag according to claim 1, wherein the opening portion comprises a screw cap.

8. The multi-chamber film bag according to claim 1, wherein the opening portion has a nozzle tip welded into the bag.

9. The multi-chamber film bag according to claim 1, wherein the opening portion comprises a socket with tear seam molded in one piece onto the film bag.

10. The multi-chamber film bag according to claim 1, wherein the clamping strip is removably disposed in the longitudinal groove of the clamping rail.

11. The multi-chamber film bag according to claim 1, wherein the clamping rail and/or the clamping strip are joined securely to the film bag by adhesive bonding or welding.

12. The process for manufacturing a curable multi-component compound using a multi-chamber film bag according to claim 1, the process comprising:

filling one of the chambers of the multi-chamber film bag with a reactive component and another one of the chambers with a hardener component for the reactive component, wherein the chambers, in a storage condition, are separated from one another in a liquid-tight manner by a separating element and wherein, in a ready-to-use condition, fluidic communication between the chambers is established by opening the separating element and the reactive component is mixed with the hardener component, wherein after the components have been mixed, the opening portion is opened and the film bag is wound in the direction of the opening portion up to the clamping rail or the clamping strip, so that the mixed components are expelled from the opening portion.

13. The process according to claim 12, wherein, in the storage condition, the clamping rail is placed on one side of the film bag and the film bag is held in the clamping rail by pressing the clamping strip into the longitudinal groove from the opposite side of the film bag, thus forming two separate chambers.

14. The process according to claim 12, wherein the mixing of the components is performed manually by kneading.

15. The multi-chamber film bag according to claim 7, further comprising a nozzle tip configured to be attached to the screw cap.

* * * * *